US006341491B1

(12) United States Patent
Paine et al.

(10) Patent No.: US 6,341,491 B1
(45) Date of Patent: Jan. 29, 2002

(54) HEAT TRANSFER DEVICE

(75) Inventors: Lisa Jane Paine, Leicestershire; Saffa Bashir Riffat, Nottingham; Richard Curtis, Chelmsford, all of (GB)

(73) Assignee: Bass Public Limited Company (GB)

( * ) Notice: Subject to any disclaimer, the term of this patent is extended or adjusted under 35 U.S.C. 154(b) by 0 days.

(21) Appl. No.: 09/492,642

(22) Filed: Jan. 27, 2000

(30) Foreign Application Priority Data

Jan. 25, 1999 (WO) ..... PCT/GB99/00255
Jul. 28, 1999 (GB) ..... 9917570

(51) Int. Cl.[7] ..... F25D 5/00; F25D 25/04; B65B 63/08

(52) U.S. Cl. ..... 62/4; 62/380; 62/60

(58) Field of Search ..... 62/480, 476, 4, 62/60, 293, 294

(56) References Cited

U.S. PATENT DOCUMENTS

| | | | | | |
|---|---|---|---|---|---|
| 4,205,531 | A | * | 6/1980 | Brunberg et al. | 62/101 |
| 4,911,740 | A | * | 3/1990 | Schieder | 62/4 |
| 4,928,495 | A | * | 5/1990 | Siegel | 62/4 |
| 4,993,239 | A | * | 2/1991 | Steidl et al. | 62/480 |
| 5,048,301 | A | * | 9/1991 | Sabin et al. | 62/101 |
| 5,079,932 | A | * | 1/1992 | Siegel | 62/293 |

FOREIGN PATENT DOCUMENTS

| | | | | |
|---|---|---|---|---|
| DE | 3313938 | * | 10/1984 | 62/530 |
| EP | 0726433 | | 4/1999 | |
| GB | 9900255 | | 2/1999 | |
| GB | 2329392 | | 3/1999 | |
| GB | 2329459 | | 3/1999 | |
| GB | 2329461 | | 3/1999 | |
| GB | 2333586 | | 7/1999 | |
| WO | 9202770 | | 2/1992 | |
| WO | WO92/02770 | * | 2/1992 | |

OTHER PUBLICATIONS

Patent application for PCT/GB 99/00255.

* cited by examiner

*Primary Examiner*—William Doerrler
(74) *Attorney, Agent, or Firm*—Baker Botts L.L.P.

(57) ABSTRACT

A self cooling can has water on a pre-wetted wick (478), in a chamber and an adsorbent in another chamber communicable upon actuation of the can with the chamber. One or both of the chambers is at low pressure. Upon actuation the pressure of the wick drops, water vapour is absorbed by the adsorbent from the internal atmosphere and more water evaporates from the wick to replace it, thereby causing a cooling effect in heat generated in the adsorbent may be contained by but a take-up system, such as phase change material or microcapsules of high heat capacity material such as water.

5 Claims, 12 Drawing Sheets

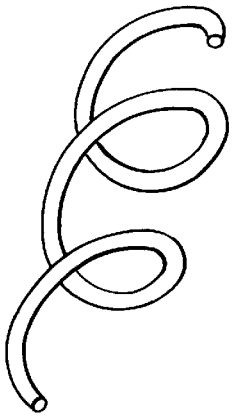
Fig. 10A
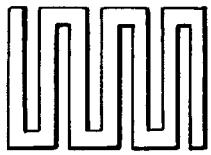
Fig. 10D
Fig. 10B
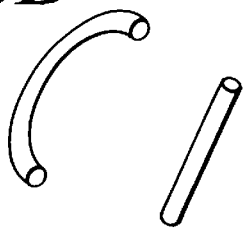
Fig. 10C
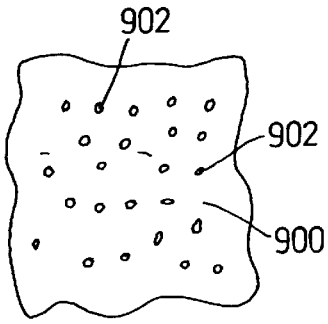
Fig. 11A
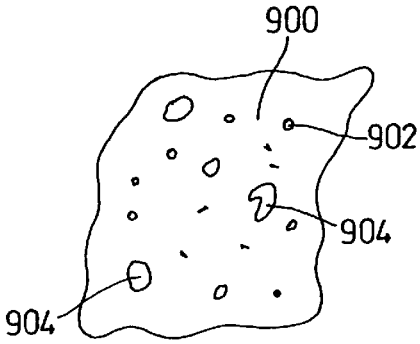
Fig. 11B

HEAT TRANSFER DEVICE

This invention relates to heat transfer devices. In particular, but not exclusively, this invention relates to heat transfer devices for heating or cooling edible or drinkable materials.

The development of efficient and "environmentally-friendly" technologies for cooling drink and food products has been sought after. The trend towards more leisure time being spent in locations away from home is on the increase as the range and availability of outdoor entertainments and pastimes increases.

Advances have been made in developing cooling devices, including cold boxes, thermoelectric picnic coolers and portable chilling units. However, these units have the disadvantages of being bulky and expensive. One device, known as the "chill can" has been subjected to International restrictions owing to environmental concerns over its use. Furthermore, little attention has been paid to the development of heating devices for heating drinks and food products.

A lot of work has already been done in the area of self-cooling cans/self-heating cans (or other containers). In order to understand fully the remainder of this application the reader is now directed to read PCT/GB99/00255 (the contents of which are hereby incorporated into this application by reference), and to read: U.S. Pat. Nos. 4,978,495, 5,168,708, 736,599, WO 9 202 770, U.S. Pat. Nos. 4,771, 607, 4,752,310, EP 0 726 433, U.S. Pat. Nos. 4,126,016, 5,088,302, 5,083,607, and 5,054,544, and our own earlier patent applications GB 2 329 461, GB 2 329 392, GB 2 329 459 and GB 2 333 586. Reading these documents, especially our own patent applications and PCT/GB99/00255, will assist in determining the full disclosure of the text and drawings that follow.

According to one aspect of the invention there is provided a heat transfer device containing a refrigerant, and said device further including operative means for allowing transfer of the refrigerant from a first region of the device to a second region of the device and means to drive said transfer of the refrigerant, thereby transferring heat from said first region to said second region, such that heat can be transferred to or from a material to be heated or cooled.

Preferably, the transfer of said refrigerant occurs by evaporation of the refrigerant. However, any other change of phase of a material may be used. For example sublimation of a solid to a gas may be used. The use of a phase change is advantageous because of the heat that must be absorbed to achieve this phase change.

Desirably, the means to drive said transfer of the refrigerant comprises a refrigerant take up agent to take up said refrigerant. Thus, heat can be extracted from the material by transfer of the refrigerant and heat is given out by the take up agent when the refrigerant is taken up thereby. The take up agent may be in the form of an adsorbent or absorbent.

According to another aspect of this invention there is provided a heat transfer device containing a refrigerant and a refrigerant take up agent, and said device further including operative means for allowing evaporation of the refrigerant whereby the take up agent takes up said evaporated refrigerant such that heat absorbed on evaporation of the refrigerant is evolved at the take up agent to enable heat to be transferred to or from a material to be heated or cooled.

Advantageuosly, the device is of a suitable size to be inserted in, or arranged in, or installed, or arranged around, a vessel suitable for holding a beverage or a foodstuff. Examples of such a vessel include beverage cans, bottles, cups, kegs, casks, and the like.

Preferably, the taking up of the refrigerant occurs at a first region of the device and evaporation of the refrigerant by the take up agent occurs at a second region.

The take up agent may be an adsorbent or an absorbent. Thus, heat of adsorption or absorption is given out when the evaporated refrigerant is adsorbed onto the adsorbent or absorbed by the absorbent and the heating or cooling of the material is enhanced.

Desirably, the device comprises a first part for the take up agent and a second part for the refrigerant. The first part is preferably at a lower pressure than the second part before the operative means is operated. An advantage of having the lower pressure in the first part is that evaporation of the refrigerant is enhanced once the pressures have been allowed to equalise.

In one embodiment, the second part may be at ambient pressure and the first part may be evacuated. In another embodiment, the second portion may be at above ambient pressure and the first part may be at ambient pressure. Alternatively, both the first and second parts are evacuated.

The skilled person will appreciate that the rate of evaporation is affected by the physical conditions surrounding the system in which evaporation is occurring. That is the pressure, temperature, temperature gradients, etc. will all affect the evaporation rate. Providing a low pressure environment may be advantageous because of a consequent reduction in the temperature at which evaporation of the refrigerant occurs.

In one embodiment the refrigerant may be water and the pressures in the first and second parts (once the operative means has allowed evaporation of the refrigerant) may be such that the water boils at substantially room temperature. Such a structure is clearly advantageous because boiling of the water will increase the rate of evaporation of the refrigerant which will speed the rate of cooling or heating of the material.

The first and second parts are advantageously isolated from each other, providing a structure in which the pressures can be maintained before activation of the operative means.

The operative means may be adapted to provide communication between the first and second parts on operation thereof. The first and second parts may be permanently attached to each other, for example they may be integral with each other. Alternatively, the first and second parts may be initially separate from each other to be attached together to allow communication therebetween on operation of the operative means.

The device may comprise a first element, which may be in the form of a first wall, on which the take up agent can be arranged, and a second element, which may be in the form of a second wall, to provide dispersion of the refrigerant.

The first element may be substantially cylindrical in shape, but it may be of any other suitable shape. The second element may be cylindrical in shape and dispersal means may be provided on said second element to disperse the refrigerant around the second element.

The dispersal means may comprise wicking means. The first and second elements are desirably spaced from each other to allow heat transfer from one to the other.

In one embodiment, the first part includes the second element and the second part may be in the form of a container adapted to release refrigerant into the second element on operation of the operative means.

In another embodiment, the second part may comprise the second element.

The operative means may comprise a release member adapted to provide an aperture in the second part to release said refrigerant or it may comprise an elongate rod having at one end thereof a substantially cylindrical member (the elongate rod and the cylindrical member may be thought of as a release means).

A membrane may be provided between the first and second parts to isolate the first part from the second part. The membrane may be formed of a metallic foil, for example aluminium foil. Alternatively, the membrane may be formed from a plastics material. Indeed, the membrane may be formed from any material which is compatible with the materials of the device.

A membrane compromising means (which may be the same as the release member) may be provided, adapted to pierce, rupture, cut or otherwise compromise said membrane so connecting said first and second parts. The operative means may comprise the membrane compromising means.

The skilled person will appreciate that the membrane compromising means should be adapted to allow communication between the first and second parts and that should the membrane compromising means simply pierce the membrane the membrane may still substantially provide a seal between the first and second parts i.e. perhaps sealing to the membrane compromising means. Therefore, the membrane piercing means may be adapted, in use, to retract slightly after compromising the membrane. This retraction may be provided by way of a cam or other similar structure. Alternatively, or additionally, the membrane compromising means may comprise a vent means, which may be duct, or hole, etc. to allow communication between the first and second parts once the membrane has been compromised.

The cylindrical member preferably has an open end arranged adjacent the membrane, whereby operation of the operative means pushes the open end of the cylindrical member into engagement with the membrane and pierces the membrane.

The release member may be in the form of a spike or pin to pierce the second part.

The second part may be formed of a suitable plastics material, and may be in the form of a bubble.

Where the device is to be used to cool the material, the second element is advantageously adapted to be arranged adjacent, or in contact with said material, and the first element is arranged such that heat transfer thereto can be dissipated to the atmosphere.

Where the device is to be used to heat the material the first element is advantageously adapted to be arranged adjacent, or in contact with, said material and the second element is arranged such that heat can be extracted from the atmosphere to be transferred to the first element thereby heating said material.

Preferably, at least the first part is in the form of a tube or pipe, although both first and second parts may be generally in the form generally of a tube or pipe. The first part or both first and second parts may be in the form of an elongate tube, wherein the first part constitutes a first portion of the tube and the second part constitutes a second portion of the tube. The skilled person will appreciate that the tube or pipe is intended to cover embodiments wherein the cross section is not circular and is for example square, triangular, elliptical, etc.

In one embodiment, the first part constitutes a double skin of a vessel holding the material to be heated or cooled, the double skin comprising inner and outer walls.

In another embodiment, the device is in the form of a sleeve having said inner and outer walls, the said sleeve being adapted to receive a vessel, for example a bottle or a can to be heated or cooled. Preferably, where the material is to be heated, the inner wall comprises said first element and the outer wall comprises said second element. Preferably, where the material is to be cooled, the outer wall comprises the first element and the inner wall comprises the second element.

In a further embodiment, the device is configured to be arranged inside a vessel for heating or cooling the material therein. The device may be manufactured separately to be inserted in the vessel when desired, or may be arranged in the vessel during manufacture.

A wicking means may be provided to assist the evaporation or movement of said refrigerant. A wicking means is advantageous because it increases the surface area from which the refrigerant can evaporate thus speeding the heat transfer process. Preferably the wicking means is pre-wetted with refrigerant prior to the operation of the operative means. Pre-wetting is advantageous because it increases the rate at which evaporation initially occurs, thus again increasing the heat transfer rate.

Pre-wetting (wetting of the wick prior to actuation of the device) is further advantageous because it should evenly distribute the refrigerant on the wick and removes the need for the refrigerant to wet the wick. Such wetting of refrigerant through the wick may slow the cooling process.

Preferably the material from which the wicking means is fabricated readily gives up the vapour phase of the refrigerant whilst maintaining the liquid phase within. This is advantageous because it allows the refrigerant to remain in the wicking means (if it is pre-wetted) before operation of the operative means but allows the refrigerant to evaporate readily. Using a material which holds onto the liquid phase is advantageous in circumstances wherein the device is tipped before operation which is clearly a possibility during transport of the device.

The wicking means can be made, for example, of metallic mesh (e.g. copper mesh or stainless steel mesh), or of a sintered powder (e.g. sintered copper or P.T.F.E.), tissue paper, plastic foam, or paper fibre.

Alternatively, the wicking means may be formed of a porous fabric, for example cloths sold under the trade mark JCloth or similar. The fabric is preferably perforated to define at least one aperture, and desirably a plurality of apertures therethrough which may serve to prevent or reduce the formation of ice on the fabric/wick.

In yet further embodiments, the wicking means may be provided from materials such a shammy (which may be real or synthetic), hyrophillic gels or granules (which may be such as water retaining gels used in horticulture), micro-fibre type materials, or Pertex™.

Localised freezing may occur which is caused by the cooling process being too efficient at localised points in the device. Freezing of the refrigerant is disadvantageous because it restricts further evaporation of the refrigerant and means that additional energy is required to melt the ice which reduces the efficiency. Pre-wetting of the wick may be advantageous because it increases the surface area over which the refrigerant evaporates which may prevent such localised freezing from occurring (if the evaporation occurs over a larger area the localised rates of cooling may be less). Further, the pre-wetting may ensure that evaporation occurs over the whole surface area of the wick. If the refrigerant is left to wet up the wick, initially evaporation will only occur from portions of the wick.

The wicking means may be corrugated, or other wise contoured. Such a structure is advantageous because it maximises the surface area of the wicking means and increases the advantageous effects.

In another embodiment, the second part constitutes a double skin of a vessel holding the material to be cooled, the double skin comprising inner and outer walls.

Preferably, the inner wall is provided with the wicking means which preferably substantially covers the inner wall. Again, the wicking means is advantageously wetted prior to use of the device.

In a further embodiment, the first part is arranged on the second part.

The first part may be in the form of a first tube and the second part may be in the form of a second tube.

The first or second part may be receivable in the material and may further include one or more heat exchange members adapted to extend into the material to enhance the transfer of heat. Enhancing the heat transfer is advantageous because it speeds the heating or cooling process.

The heat exchange member(s) may comprise a plurality of fins which are preferably in the form of wire loops. Both of these structures providing simple yet efficient heat transfer.

Further heat exchange members may extend in the second part, which may comprise a plurality of fins preferably in the form of wire loops.

Heat absorption means may be provided in association with the take up agent. Such an absorption means is advantageous because it may promote further take up of the refrigerant because the take up agent may be maintained at a lower temperature. A lower temperature of the take up agent may not only increase the rate of heating or cooling of the material but may also reduce make the device more pleasant to hold and perhaps safer as well.

The heat absorption means may be a heat sink provided in the take up agent. The heat sink may comprise fins (which may be metal), coils/loops (which may be of wire) or portions of a heat absorbing material (which may be a metal). Each of these structures is beneficial because it will help to remove heat from the take up agent thereby increasing the rate of heating or cooling of the material. The heat absorption means may comprise a powder of a heat absorbing material, may be a metal powder. The heat take up means may comprise powder, particles, or granules distributed through the body of adsorbent material, preferably substantially uniformly distributed, and preferably distributed throughout substantially the whole of the body of adsorbent.

The heat absorbing means may be moulded into the take up agent. Indeed a mixture of heat take up material and adsorbent may be formed (e.g. moulded) into a cake or body.

The heat absorption means may also comprise pockets of a material which is adapted to change phase (a phase change material) as heat is absorbed. The skilled person will appreciate that a phase change requires an enthalpy change which in turn requires a heat input. Such a phase change is therefore advantageous because of the increased amount of heat absorbed from the take up agent. The phase change material may change from solid to liquid, from liquid to vapour or possibly from solid to vapour. The heat absorption means may comprise capsules or micro-capsules. The capsules may contain a phase change material or may contain a material with a high heat capacity, perhaps water, oil, or air. They may have a wall of a first material and a centre of a different material, which may change phase with temperature over the operating temperature of the device (e.g. plastics, or other material, capsules may surround a wax centre which may melt, absorbing energy, in use). The capsule may have a high thermal conductivity wall, for example a metal wall, or metal foil. Alternatively, there may be no containment wall for the melted phase change material, which when melted may be permitted to contact the adsorbent directly.

The heat absorption means may comprise pockets of air.

The heat adsorption means may also comprise a tube or other container extending through the take up agent. The tube may contain a fluid, which may be a liquid. Filling the tube with a liquid is advantageous because of the high heat capacity of the liquids which will increase the amount of heat which can be absorbed from the take up agent, thereby increasing the rate of heating or cooling of the material.

Water may be used to fill the tube, providing a cheap material with a high thermal mass.

The tube may be formed into a convoluted shape, such as a spiral, thereby increasing the length of tube (and therefore the heat capacity) which can be fitted within the take up agent. The skilled person will appreciate that it is important for the heat absorption means to have a large surface area to increase the rate at which heat can be absorbed.

Conveniently the tube is fabricated from a material with a high heat conductivity. The tube may be fabricated from a metal. This structure is advantageous because it increases the amount of heat that can be absorbed by the tube.

Insulation means may be provided. The insulation means may insulate the first part, or the second part or perhaps both of the first and second parts.

The skilled person will appreciate that insulation on the first part (around the take up agent) may be adapted to prevent heat given off from the take up agent from heating any of the refrigerant, the atmosphere or the material. If the device is adapted to cool the material then it is clearly disadvantageous for heat from the take up agent to reach the material. Further, it is clearly disadvantageous for the device to become too hot and it is desirable to provide insulation to prevent this from occurring. The insulation may be required to prevent significant, rapid, heat transfer, rather than completely block heat transfer. For example, it is envisaged that a can of self-chilled beverage would be drunk by the consumer in, say, 15 minutes after opening, or 20 minutes (or perhaps 30 minutes). After, next say 10 minutes or 15 minutes (a period) it may not matter to the consumer too much if the beverage begins to warm up due to heat transfer from the adsorbent—they have by then had a first cold draught from the can, and the can is in any event absorbing heat from the external environment. Thus a "firewall" delay of heat transfer from the adsorbent may be enough.

Further, it will be appreciated that insulation on the second part (around the refrigerant) may be adapted to prevent heat from reaching the refrigerant from the atmosphere, the material or the take up agent. If the device is adapted to heat the material then it is clearly disadvantageous for heat to be absorbed by the refrigerant from the material. Insulation may be provided around the second part to ensure that heat is not absorbed from the atmosphere by the refrigerant: if the material is to be cooled then it is advantageous that heat is absorbed from the material rather than from the surroundings.

One of said first and second elements may surround the other of said first and second elements. The other of said first and second element can preferably be arranged in a material to be heated or cooled.

In one embodiment, the first element is in the form of a first tube surrounding the second element, which is preferably in the form of a second tube. The second element is desirably adapted to be arranged in a material to be cooled.

A conduit arrangement may extend between the first and second elements to conduct the evaporated refrigerant, thereby transferring heat from the second element to the first element. When the device is to be used to cool the material, the first element surrounds the second element and, when the device is to be used to heat the material, the second element surrounds the first element.

Heat exchange members may extend from the first or second element into the material to be heated or cooled.

The first and second elements may comprise first and second tubes initially separate from each other and adapted to be connected in communication for heating or cooling. The first and second elements may be connected by the operative means.

The second part may comprise a container connected to the first part.

The operative means may comprise a valve between the first and second parts. The valve is preferably movable to an open position to allow the first and second parts to communicate with each other.

Heat absorption means may be arranged adjacent one of the first or second elements. Where the device is to be used to cool the material, the heat absorption means may be arranged in thermal contact with the first element to absorb heat given out by the take up agent. The heat so absorbed by the heat absorption means may be given off to the atmosphere.

Where the device is to be used to heat the material, the heat absorption means may be arranged in thermal contact with the second element, whereby heat absorbed by the heat absorption means can be desorbed via the second element to evaporate refrigerant in the first part.

In one embodiment, the heat absorption means is provided in a chamber which may be defined at least partially by the first or second element. Preferably, the chamber surrounds, or is surrounded by, said first part.

In one embodiment, the chamber is in the form of a substantially cylindrical tube defined substantially wholly by said first or second element internally of the first part. The skilled person will appreciate that the chamber could have any other cross section and is not necessarily cylindrical.

In another embodiment, the chamber is in the form of a sleeve defined partially by the first or second element externally of said first part. The sleeve is conveniently defined between said first or second element and an external wall.

In one embodiment, the heat absorption means comprises a refrigerant adapted to evaporate when heat is absorbed thereby. Valve means may also be provided to release to the atmosphere evaporated refrigerant from the heat absorption means. The valve means is particularly suitable where the device is to be used for cooling the material.

In another embodiment, the heat absorption means may be a phase change material adapted to change phase from solid to liquid or from solid to vapour on absorption of heat. Where the phase change material changes from solid to vapour, valve means may be provided to release the vapour to the atmosphere. The use of valve means is particularly suitable where the device is to be used in cooling the material.

In a further embodiment, the heat absorption means may be a heat pipe preferably having one end region in thermal contact with the first part and the opposite end region outside the first part. The end region of the heat pipe external of said first part may be provided with fin means to assist in heat transfer to or from the heat pipe. In this embodiment, said one end region is preferably surrounded by the first part.

In another embodiment, the device may comprise at least one heat pipe, and preferably a plurality of heat pipes extending from the second part into the material. The, or each, heat pipe is preferably in the form of a needle heat pipe. In this embodiment, a valve is provided between the second part and the first part, whereby when the valve is opened, refrigerant in the second part is evaporated to be taken up by the take up agent in the first part, and the evaporation of the refrigerant causes heat to be transferred from the material along the heat pipes to an end region of the or each heat pipe in the first part, thereby cooling the material. In this embodiment, the first part is arranged outside the vessel containing the material, and the second part is arranged inside the vessel. Alternatively, where heating is required, the second part may be arranged outside the vessel, and heat pipes may extend from the first part inside the vessel whereby when the valve is opened, evaporating refrigerant is taken up by the take up agent and heat dissipated by the or each, heat pipe into the material.

The above embodiments are particularly suitable for use with a take up agent in the form of an adsorbent.

In a further embodiment, where the take up agent comprises an absorbent, the device may be provided with a third part initially containing the absorbent. The third part may be provided with release means, whereby when the release means is activated, absorbent is released into the second portion. In this embodiment, when the operative means for the second part is operated, the refrigerant is released into the first part to be evaporated therein and absorbed by the absorbent thereby releasing heat. The third part may be a further bubble, and the operative means may be suitable for piercing the bubble, or otherwise forming an aperture in said further bubble.

A material mixing means may be provided adapted to ensure that the material is mixed. The skilled person will appreciate that the cooling/heating process relies on temperature differences. Unless the material is mixed temperature gradients may occur in the material which slows the cooling or heating process. Therefore, mixing the material is advantageous because it can help to prevent the occurrence of such gradients and can help to increase the rate at which the material is heated or cooled. The skilled person will appreciate that the rate of heating/cooling should be higher if there is more of a temperature difference, Therefore, if temperature gradients exist within the material (for instance cooler toward an outside region and hotter toward a central region) then the rate of cooling/heating may be reduced because the temperature difference between the material and the first or second part is reduced. Therefore, removing temperature gradients within the material is beneficial because it may increase the rate of cooling or heating.

The material mixing means may comprise a disk or other body provided within the material. This is especially advantageous when the material is a liquid.

Preferably the disk/body is perforated. The disk/body may be adapted, in use, to move through the material, thus providing a mixing action. The device may be adapted to be inverted to cause the disk/body to move through the material under the influence of gravity. Such a structure is simple yet effective in providing a mixing action. Alternatively a manually operated mixing/circulating mechanism may be provided, for example a finger-operated pump or paddle.

Of course, the skilled person will appreciate that any means that mixes the material will prevent temperature gradients from forming. Pumps, vanes, stirring means may all be provided to prevent temperature gradients from occurring.

In one embodiment, the device may comprise a pipe (or a linked plurality of pipes).

Preferably, a device according to this embodiment comprises an elongate pipe having a first portion to containing the adsorbent or absorbent, a second portion initially separated from said first portion and adapted to contain the refrigerant and communication means between said first and second portions, whereby operation of said communication means causes the refrigerant to be adsorbed or absorbed by the adsorbent or absorbent, with evolution of heat from the first portion of the device and corresponding absorption of heat at the second portion of the device.

The second portion (to contain the refrigerant) is generally integral with the elongate pipe. The second portion may be adapted to contain the refrigerant either under sub-ambient or under super-ambient pressure, I.e. under vacuum or under pressure respectively, relative to ambient pressure.

The second portion may contain the refrigerant under permanent sub-ambient or super-ambient pressure.

Alternatively, means, such as a pump, may be provided to produce a sub-ambient or super-ambient pressure in the first portion when required. Means may also be provided to purge air from the first portion thereby increasing the efficiency of the device.

The first portion (to contain the adsorbent or absorbent) may likewise be integral with the elongate pipe.

Alternatively, the first portion may be initially discrete relative to the second portion and adapted to be connected thereto. Such connection may preferably include operating means for causing communication between the first and second portions of the elongate pipe.

The communication means may, for example, comprise one or more valves (such as one-way or throttle valves), Alternatively, the communication means may comprise a three-way (or ejector) valve.

In another embodiment, the heat-transfer device may comprise a pipe (or a linked plurality of pipes).

In a further embodiment, the device comprises an elongate pipe in which the refrigerant and the adsorbent or absorbent are combined and under super ambient pressure within the pipe. In this embodiment, the adsorption or absorption of the refrigerant by the adsorbent or absorbent, with consequent cooling and heating respectively, is achieved by the release of the super-ambient pressure by means of a valve or the like provided in operative association with the elongate pipe.

In yet another embodiment, the refrigerant is contained, under sub-ambient pressure, in an outer skin of a vessel containing a liquid such as a soft drink) to be cooled. A valve is provided in the skin for the release of the vacuum and the valve is operable by means including a container for the adsorbent.

The device according to the present invention, may be permanently fixed inside a vessel to contain a liquid to be cooled or heated.

Alternatively, such a device may be provided as a "portable" or "pocket" device, to be placed in an opened container (such as a can of beer to be cooled or a can of soup to be heated) when required.

Devices according to the present invention may be operated by producing communication between the refrigerant and the adsorbent or absorbent (generally by actuating a valve). The provision of the communication causes the refrigerant to volatilise and to interact with the adsorbent or absorbent. As a result of that interaction, heat is evolved from the adsorbent or absorbent and heat is correspondingly absorbed from the surroundings of the refrigerant.

In one instance, where a device according to the present invention is placed in, say, a can of beer, with the portion containing the adsorbent or absorbent being outside the can and the portion containing the refrigerant material being inside the can, interaction between the refrigerant and the adsorbent or absorbent causes the evolution of heat to the atmosphere and absorption of heat from the beer within the can leading to cooling.

In a second instance, where the device is placed in, say, a can of soup, with the portion containing the adsorbent or absorbent being inside the can, interaction between the refrigerant and the adsorbent or absorbent again causes evolution of heat from the adsorbent, but the heat evolved is used to heat the soup within the can instead of being vented to the atmosphere.

Operation of the valve may be achieved by means external to the device (as, for example, where a pump or the like is operatively associated with the elongate pipe or the adsorbent material is contained in a discrete "plug-in" member). Alternatively, the valve may be actuated by means of the internal pressure of the contents of a vessel (as, for example, a can of drinkable liquid to be cooled or heated by means of a device according to the present invention).

Refrigerants suitable for use with a present invention preferably include the following:

Water, alcohols (e.g. methanol, ethanol), haloalcohols (e.g. trifler-ethanol), haloalkanes (e.g. trifluoro-ethane), alkanes (e.g. $C_3$ to $C_6$), ammonia, carbon dioxide, aromatic hydrocarbons (e.g. benzene, toluene, aniline), acetophenone, butyl acetate, butyric acid, cellulose acetate, cresol, cumene, cyclohexanol, cyclohexanone, dibutylphtalate, diethanolamine, diethylsulphate, dimethylformamide, dimethylhydrazine, dimethylphtalate, ethylene glycol, hydrazine, methylhydrazine, methylpyrrolidinone, naphthalene, styrene, sulfolane, tetrachloroethylene, trichloroethylene, undecane.

In the preferred embodiment the refrigerant may be water. Water is advantageous because it is cheap and readily available and is also non-toxic. Clearly, when the device is being used in conjunction with foodstuffs it is desirable that there is no chance of contamination of the foodstuff occurring.

The skilled person will appreciate that a mixture of a first substance and a second substance will have a different boiling point to a sample of substantially pure first substance. In some embodiments the refrigerant may be a mixture adapted to reduce the boiling point of the refrigerant. For instance, the refrigerant may be a mixture of water and alcohol.

Take up agents suitable for use with the present invention preferably include the following:

silica gel, activated alumina, zeolites (molecular sieves), activated charcoal, alkanes (e.g. $C_3$ to $C_6$), alcohols (e.g. methanol, ethanol), amides (e.g. N, N-dimethyl acetamide), ketones/lactams (e.g. N-methyl pyrrolidone), carboxylic acid salts (e.g. potassium formate), esters, alkali metal salts (e.g. lithium bromide, lithium nitrate).

Thus, the refrigerant may be a volatile liquid or a gas, and the take up agent may be a solid or a liquid.

Suitable combinations of refrigerant/take up agent for use with the present invention preferably include the following:

water/zeolites-activated carbon, ethyl alcohol/silica gel, water/silica gel, water/activated alumina, carbon dioxide/activated alumina, water/zeolites 4A, 5A, 13X, ammonia/zeolites 4A, 5A, 13X, carbon dioxide/zeolites 4A, 5A, 13X, ethene/activated carbon, ammonia/activated carbon, water/activated carbon, methyl alcohol/activated carbon, water/polymers, ammonia or water/metal in organic salts (e.g. water/$CaCl_2$, ammonia $CaCl_2$ hydrogen/$LaNi_4$, hydrogen/

FeTi, water/potassium formate), hydrofluorocarbons (HFC) refrigerant/adsorbent combinations (e.g. R134a/activated carbon), fluid mixtures (e.g. water, methanol/activated carbon, water/ammonia, ammonia (or carbon dioxide/potassium formate, water/lithium bromide, N-methylpyrrolidinone/trifluorethanol, dithioglycol (DTG)/tetrafluorethane, water/ammonia-lithium nitrate, carbon dioxide/N, N-dimethylacetamide, $H_2O$/CaO.

It is desirable to increase the surface area of the adsorbent/absorbent as much as possible to increase the rate at which the adsorbent/absorbent can take up the refrigerant. This can be achieved by the following means, for example coating the surface with the adsorbent/absorbent (e.g. by using a binder or growing adsorbent/absorbent on the surface) using adsorbent/absorbent membranes (e.g. growing zeolites on a mesh) using an adsorbent/absorbent cloth (e.g. activated carbon), providing channels within the adsorbent/absorbent (or take up agent), providing the take up agent as a powder or as pellets.

Suitable phase change materials that can be used with the present invention preferably include the following: Glycerol, oils, coconut/butter, paraffin wax, glauber salt ($Na_2$ $SO_4$,$10H_2O$, butyl phenol, methanol, pentane, ethane.

In most circumstances, the take up agent can be regenerated once adsorption has occurred. Regeneration may be achieved by heating the adsorbent (for example by means of a Peltier or like device) or by means of an integral compressor provided in association with the device.

The present invention further provides a method for heating or cooling the contents of an enclosed vessel, in which one or more heat transfer devices of the type hereinbefore described are placed in contact with the contents of the vessel and each said device is caused to transfer heat by means of an adsorption-based process between a refrigerant material and an adsorbent material, whereby heat is respectively liberated into or absorbed from the contents of the vessel.

Thus, a method according to the present invention can be applied to the heating of soup, tea or the like in an enclosed vessel.

Alternatively, the method can be applied to the cooling of beer, soft drinks or the like in an enclosed vessel.

According to another aspect of the present invention there is provided a heat-transfer device comprising an elongate, generally tubular member adapted to contain a refrigerant and an adsorbent or absorbent, together with means to cause the refrigerant to be adsorbed by the adsorbent, whereby heat is evolved from the adsorbent or absorbent and absorbed by the refrigerant material.

According to another aspect of this invention there is provided an assembly comprising a vessel for holding a material to be cooled or heated and a heat transfer device as described above arranged in thermal contact with the material.

According to another aspect of the invention comprises a self cooling beverage container having a beverage chamber adapted to hold a beverage, an adsorbent, an evaporative refrigerant, an isolator isolating the refrigerant from the adsorbent, and an actuator adapted in use to communicate the adsorbent with the refrigerant so that, in use, the evaporative refrigerant evaporates and is adsorbed by the adsorbent, evaporation causing cooling of the beverage in use.

Preferably the adsorbent comprises activated carbon and the refrigerant comprises water. The heat take up material may be provided associated with the adsorbent, the heat take up material comprising at least one of i) phase change material or ii) heat exchange members comprising wire loops or wire bushes; or iii) liquid-cooled surfaces provided in a body of the adsorbent.

A pre-wetted wick, wetted before activation of the device, may be provided, the wick being wetted with the refrigerant and the relationship between the refrigerant and wick being such that when activated the refrigerant evaporates from the wick but before activation the wick holds the refrigerant such that the liquid refrigerant does not seep under gravity to leave a wick having dry areas, irrespective of the orientation of the container during storage or prior To use. The relationship between the wick and refrigerant is preferably such that the wick is substantially saturated with refrigerant, and remains so over substantially the whole evaporative surface prior to use of the device, irrespective of the orientation of the container during pre-use storage. A refrigerant reservoir may be provided, refrigerant in the reservoir replacing refrigerant in the wick as refrigerant in the wick evaporates in use.

Beverage mixing means may be provided adapted to ensure that the beverage to be cooled is mixed or made turbulent during cooling of the beverage. Said beverage mixing means may comprise a gravity moved member adapted to move through the beverage under the influence of gravity. The member may comprise a sliding body provided with through-holes. The beverage mixing means may comprise a so-called "widget", adapted to generate a head on the beverage.

The heat take up material comprises a tube, capsule or other closure provided within a body of adsorbent. The closure may comprise a spiralled or curved tube. The closure may contain at least one of i) water; or ii) phase change material.

The adsorbent may be provided as a body of adsorbent material and the body may be provided with surface area maximising means which may comprise any one of the of following: i) channels provided on or within the body; ii) the adsorbent being provided in granular form or in powder form.

A membrane may be provided to separate the adsorbent and refrigerant prior to the actuator allowing the refrigerant to be adsorbed.

The wick may be provided with apertures, which may assist in the prevention of ice. The adsorbent may be provided as a body and there are distributed in the adsorbent body of a plurality of microcapsules comprising water or a waxy phase change material. The microcapsules may contain phase change material which melts, in use, and wherein the microcapsules have a sheath to retain the melted phase change material. The adsorbent may be provided as a body, and wherein the adsorbent body has provided in it a plurality of channels adapted to take refrigerant vapour to different regions of said body.

The self cooling beverage container may have a beverage chamber, a beverage in the beverage chamber, a body of adsorbent material, an evaporative refrigerant held on wick, an isolator isolating the wick from the adsorbent body, an actuator adapted in use to communicate the adsorbent with the wick so that said evaporative refrigerant evaporates and is adsorbed by the adsorbent, with the evaporation cooling the beverage; and wherein the adsorbent is activated carbon, the evaporature refrigerant is water, and the evaporative process occurs at sub atmospheric pressure; and wherein a mixer is provided in said beverage chamber, said mixer being gravity operated by inversion of the container to cause said mixer to move and thereby mix the beverage to assist cooling of the beverage; and wherein said adsorbent body has heat take up means provided in it, said heat take up means comprising at least one of; i) microcapsules of phase change material or heat capacity material distributed in said body; ii) liquid cooled surfaces provided on said adsorbent body; and wherein said wick is thermally coupled with at least one of; i) heat exchange fins extending into said beverage; ii) extensions or loops of wire in thermal contact with said beverage.

A method of cooling a beverage may comprise providing a container having a gravity powered beverage mixer and actuating said actuator, and then periodically inverting said container to cause said gravity moved member to move repeatedly through said beverage, in opposite directions relative to said conductor, and repeatedly moving said beverage prior to opening said beverage container.

Embodiments of the invention will now be described by way of example only, with reference to the accompanying drawings in which.

Figure 3:
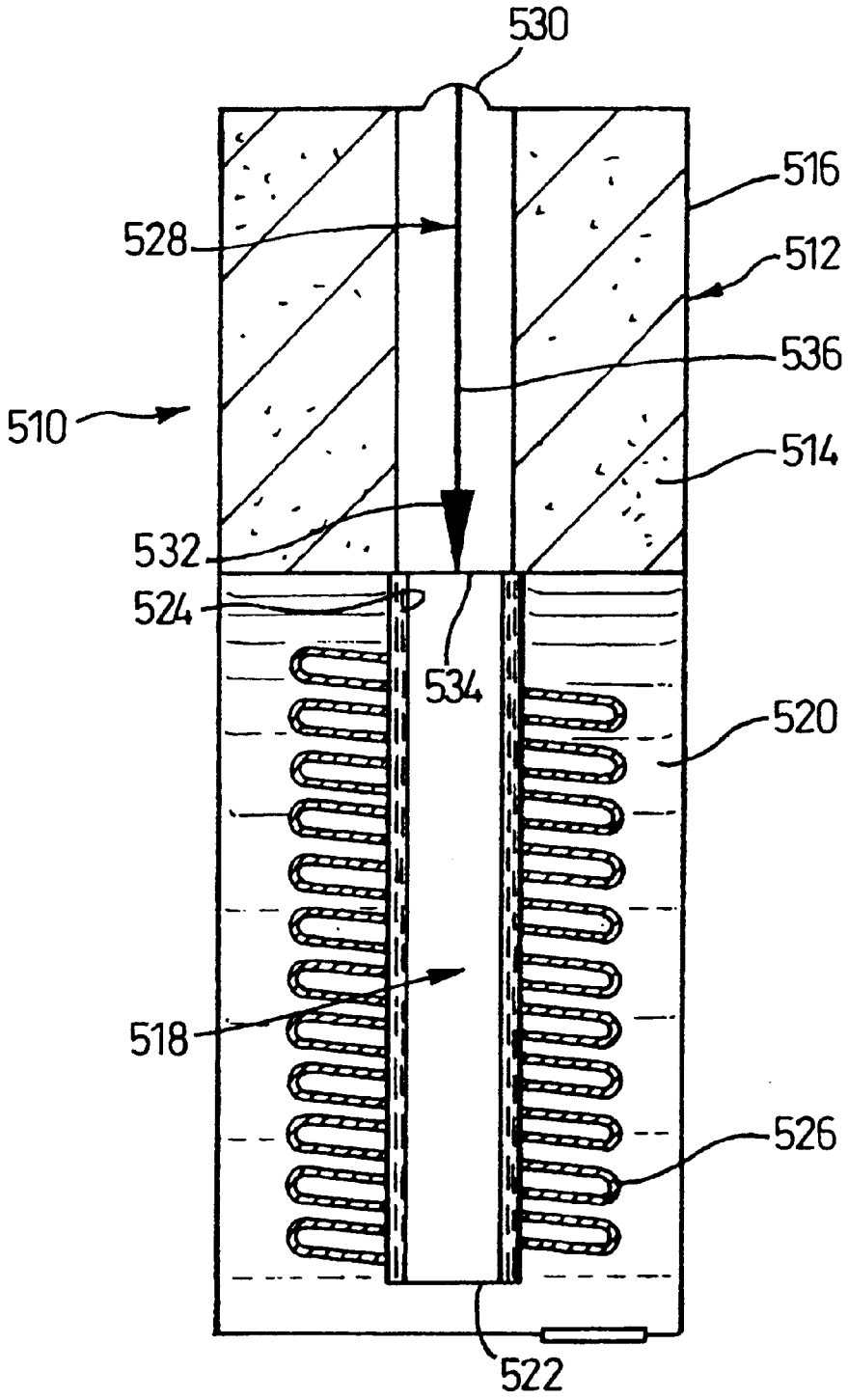
FIG. 3 is a further embodiment of the heat transfer device showing the use of heat exchange means to enhance a transfer.
Figure 4C:
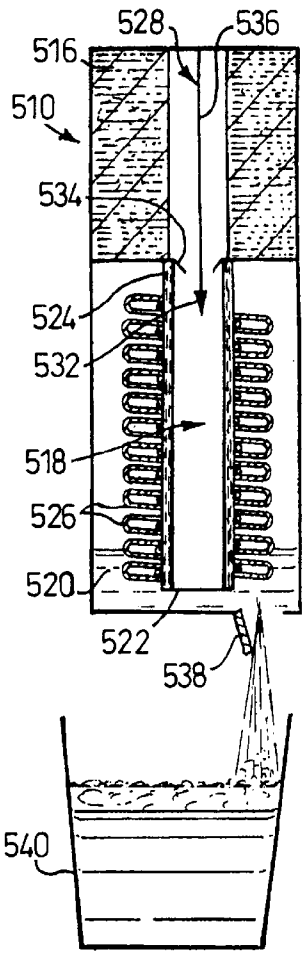
Figure 4B:
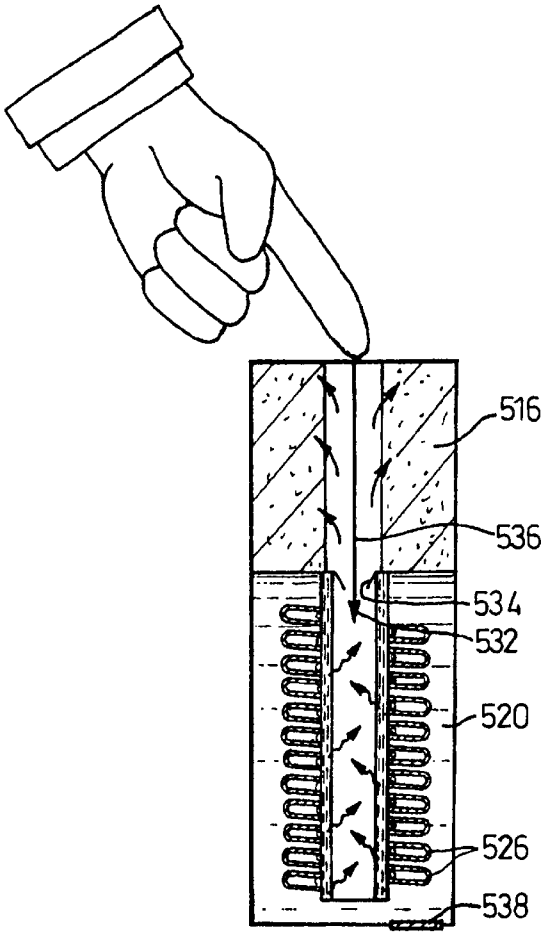
Figure 4A:
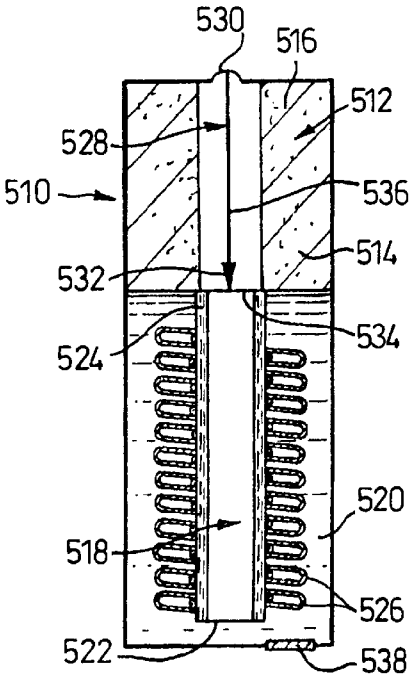
Figure 5:
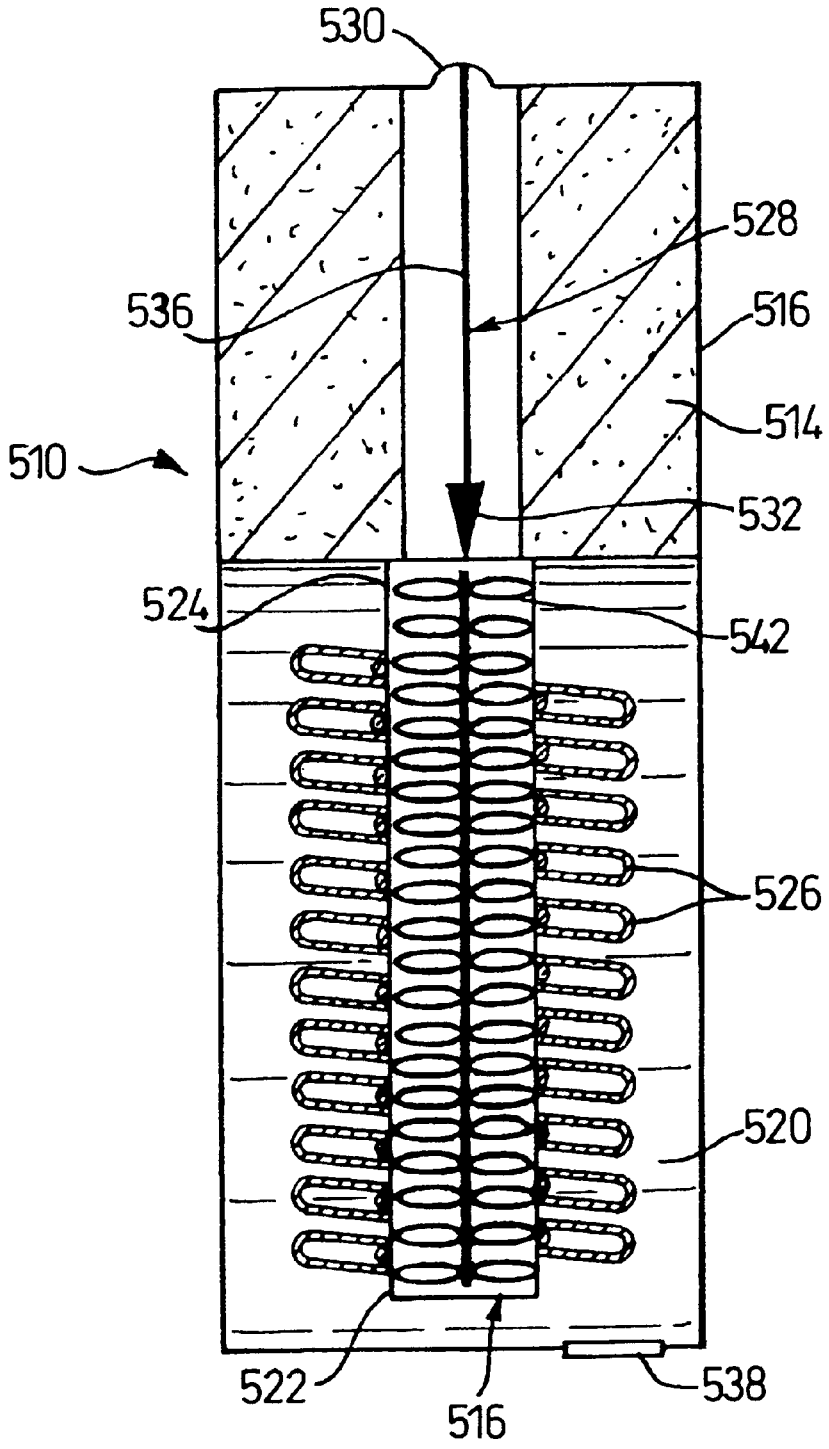
Figure 6:
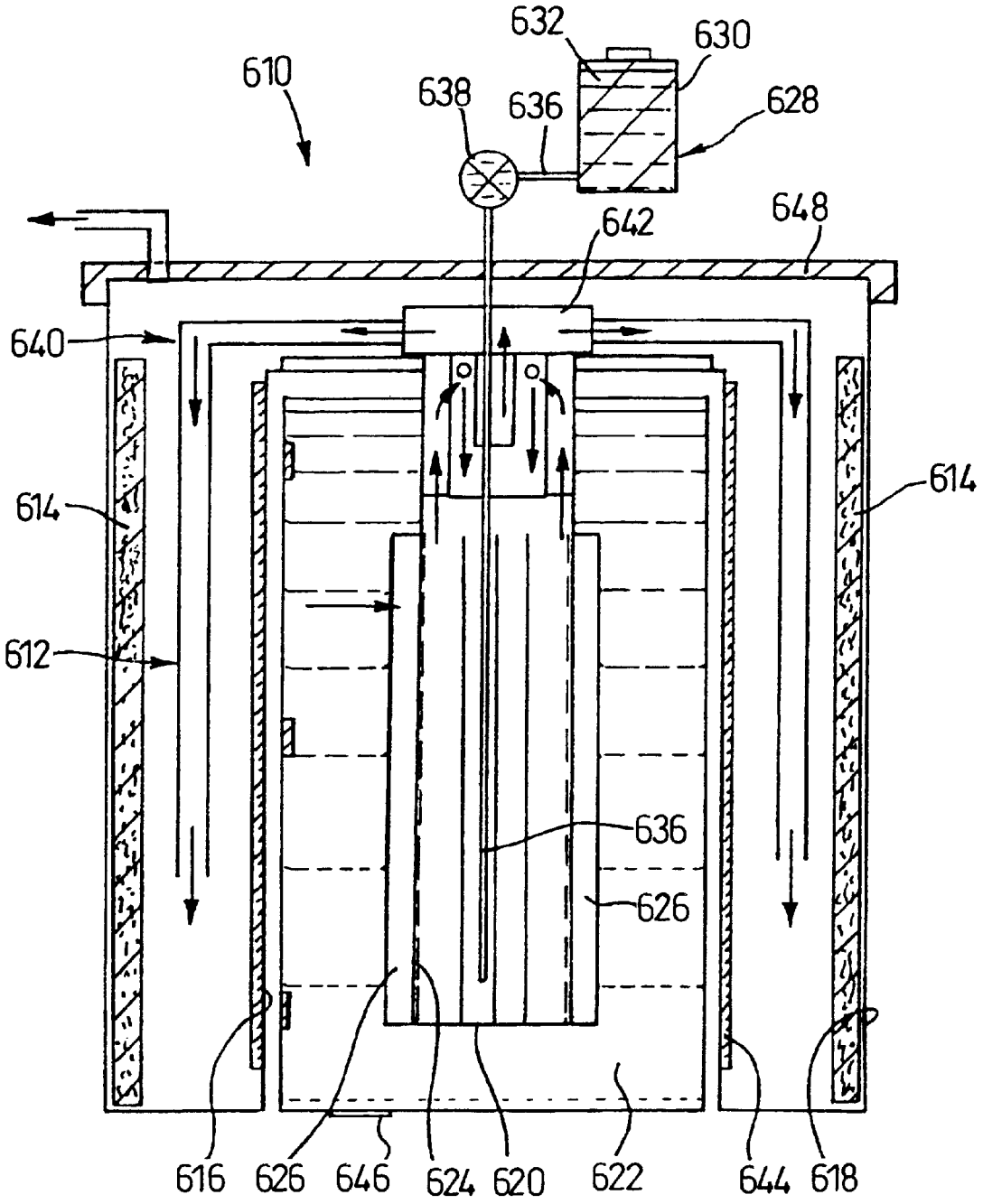
Figure 7:
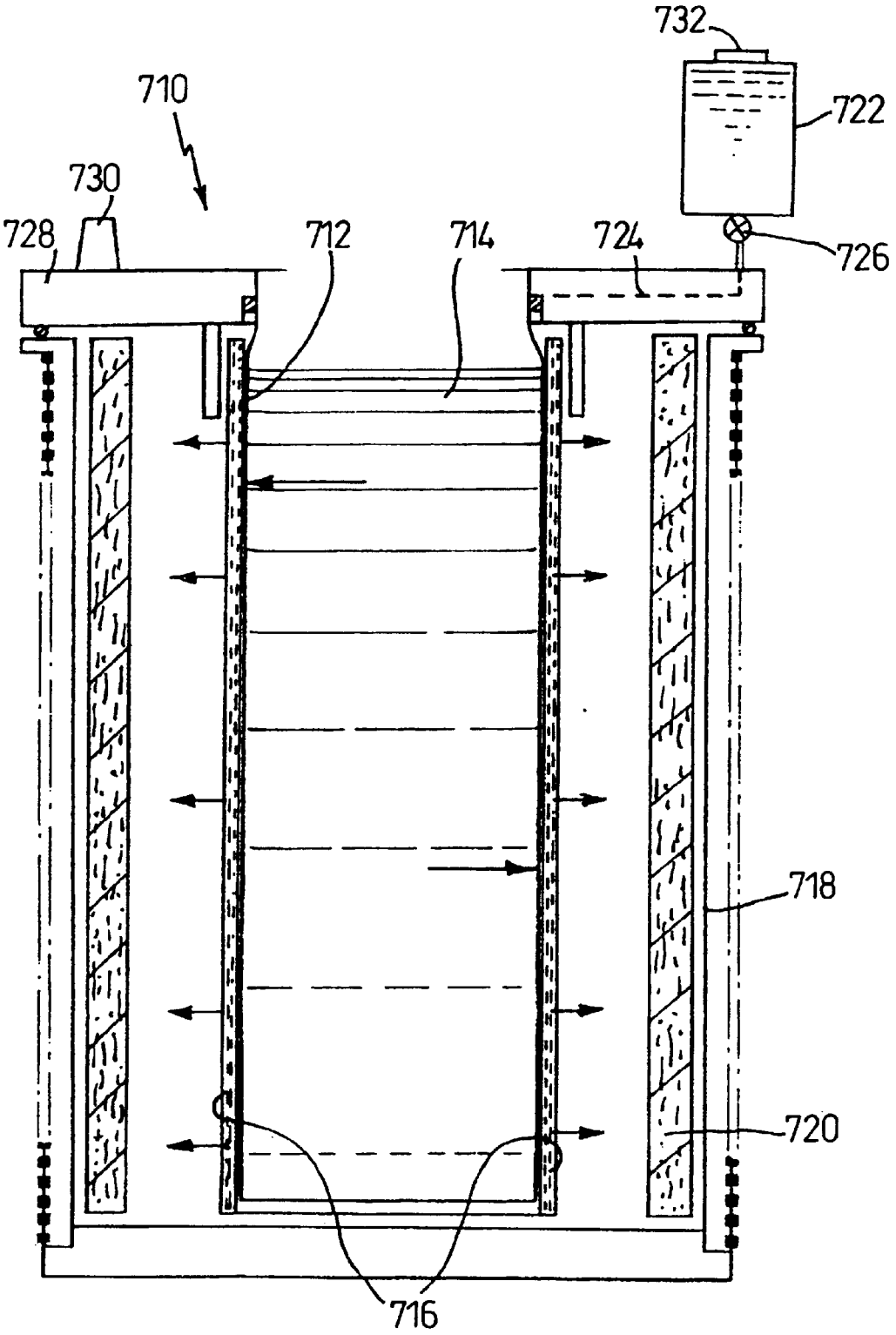
Figure 8:
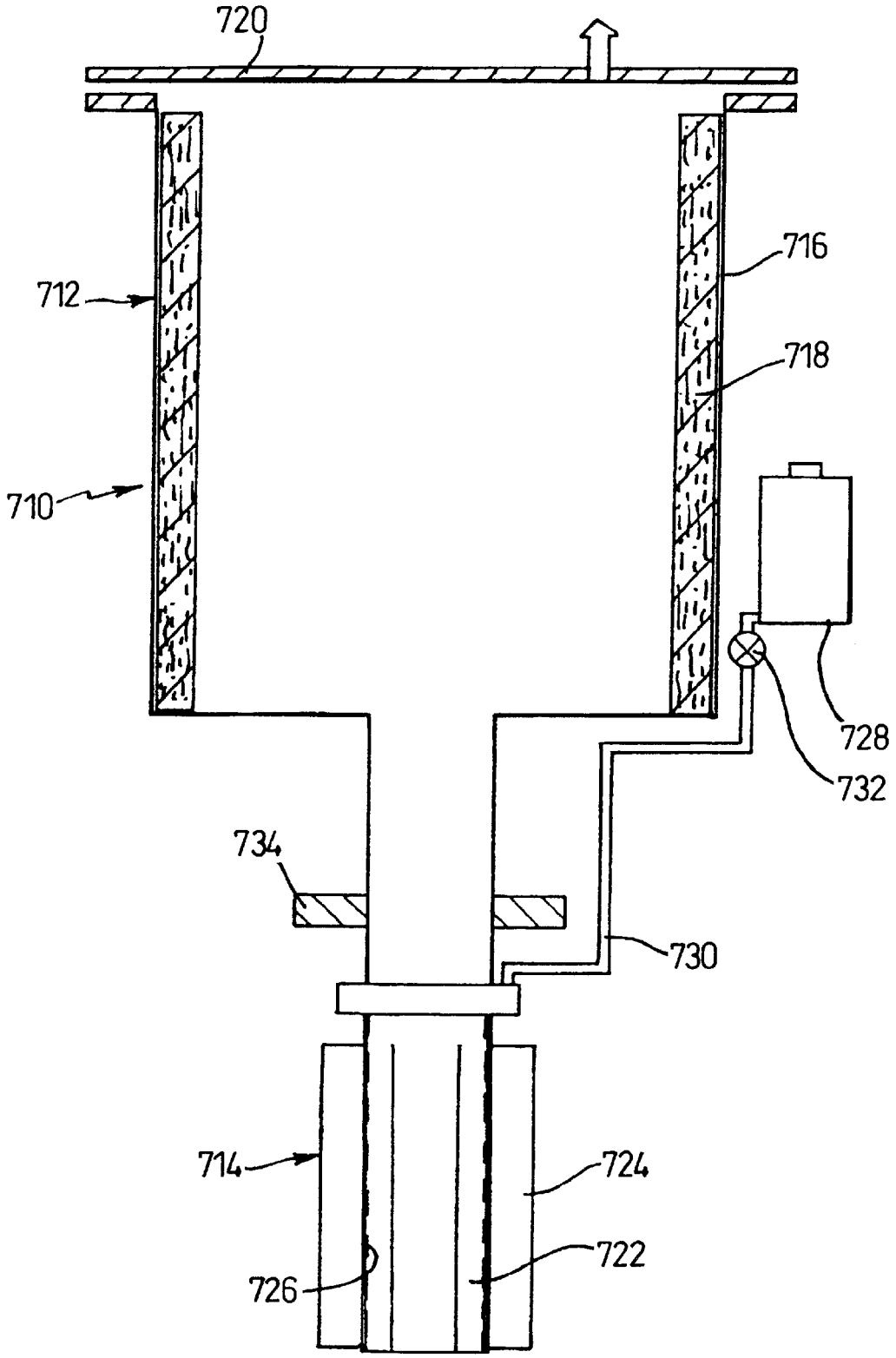
Figure 12A:
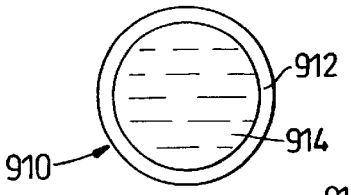
Figure 12B:
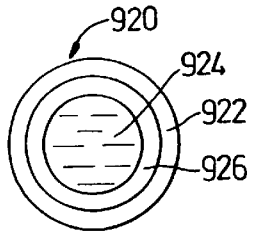
Figure 12C:
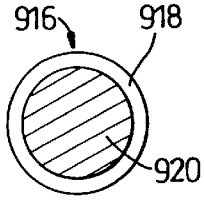
Figure 14:
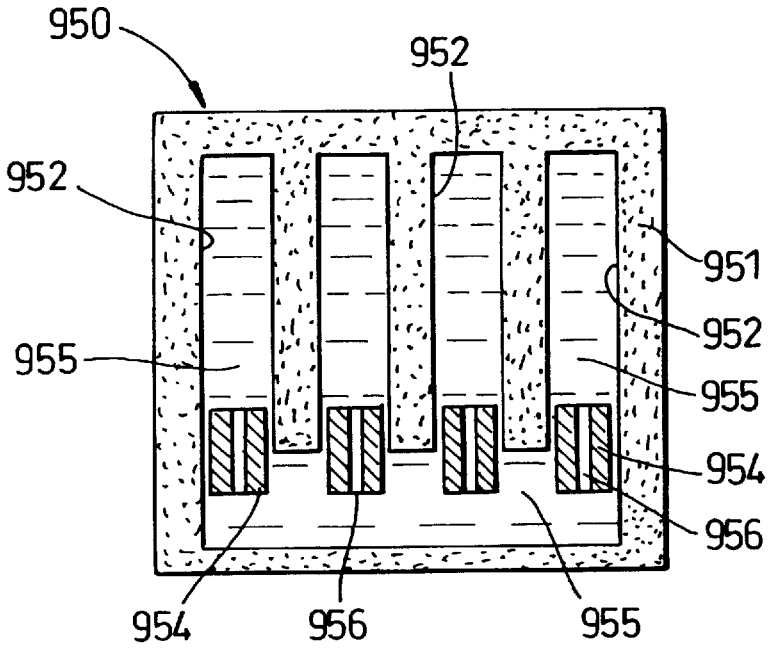

FIGS. 4A to C show the sequence of events for using the embodiment shown in FIG. 3;

FIG. 5 is a modification of the device shown in FIG. 3;

FIG. 6 is a further embodiment of the heat transfer device, in which the adsorbent is arranged around the material, and a conduit arrangement is used to deliver evaporated refrigerant to the adsorbent;

FIG. 7 is a further embodiment of the heat transfer device;

FIG. 8 is a further embodiment of the heat transfer device using an enlarged chamber for the adsorbent;

FIG. 9 shows schematic representations of further possible enhancements of the system;

FIGS. 10A to 10D show heat take up mechanisms which may be provided associated with the evaporant take up medium;

FIGS. 11A to 11B show heat sink material distributed in adsorbent/evaporant take up material;

FIGS. 12A to 12C show further heat sink structures;

FIGS. 13A to 13D show ways of getting the evaporated coolant to deeper parts of a body of evaporant take up material;

FIG. 14 shows a way of cooling the adsorbent/take up agent; and

Figure 15:
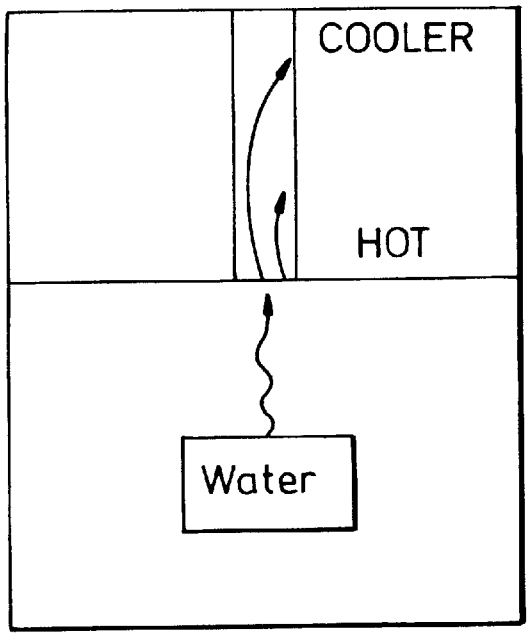

FIG. 15 shows a self-cooling beverage container with a temperature gradient over the volume of adsorbent.

Figure 1:
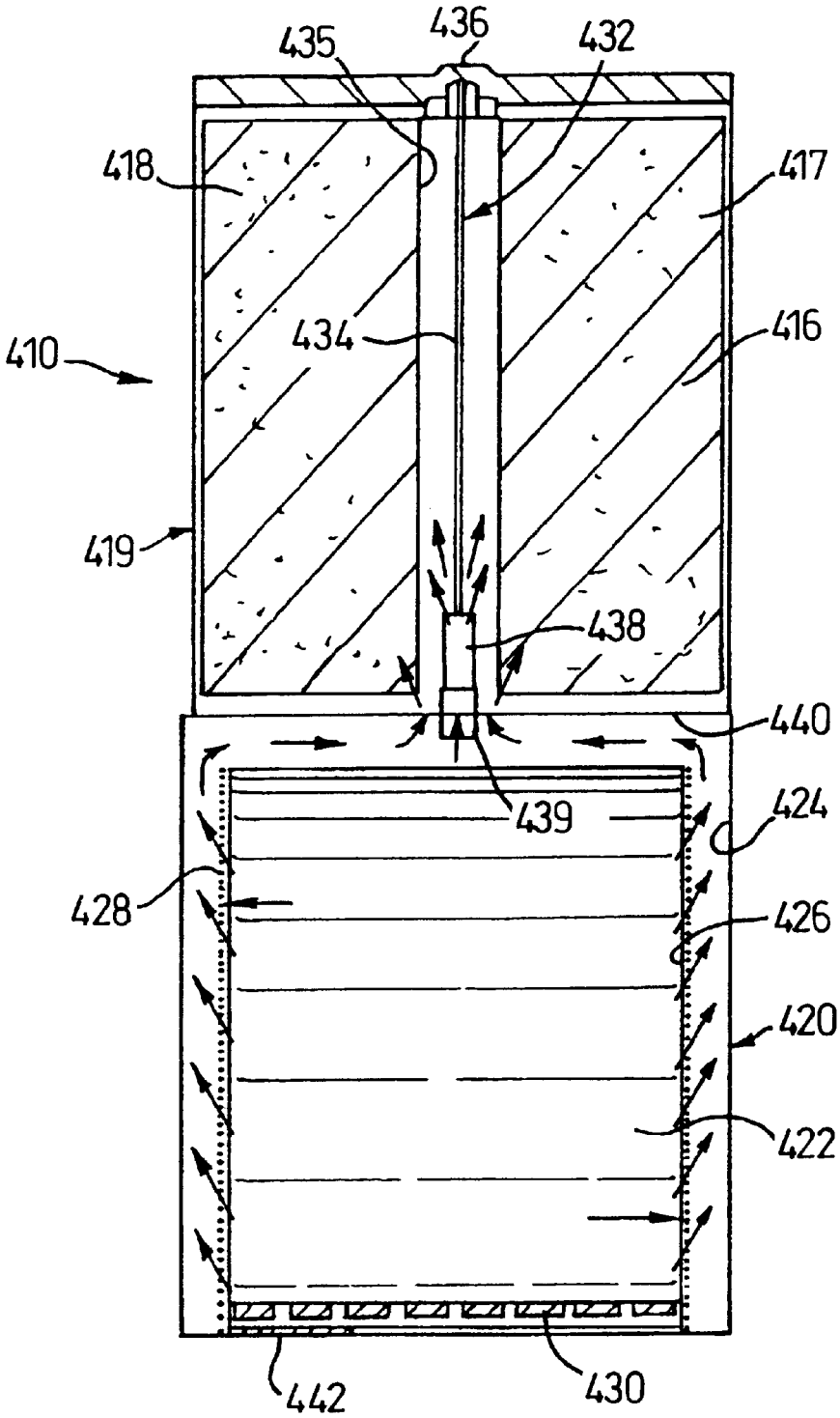
FIG. 1 shows a self-cooling can of beverage in accordance with the invention.

Referring to FIG. 1 there is shown a can 300 having a heat transfer device 410 comprising a first part 416 having a cylindrical chamber 419 for an adsorbent 418 (e.g. activated charcoal), and a second part 420 which cools a beverage 422 (e.g. beer, lager, soft drinks or the like) to be cooled, and comprises a double skin in the form of a pair of concentrically arranged outer and inner walls 424, 426. Wicking means 428 is provided on and surrounds the inner wall 426. The wicking means 428 is soaked in a suitable refrigerant, for example water, and can be a porous fabric material capable of dispersing the refrigerant throughout the fabric by capillary action. One example of a suitable fabric is that sold under the Trade Mark J-Cloth. The space between the outer and inner walls 424, 426 is evacuated to a low pressure. Mixing means in the form of a disc or body 430 provided with a plurality of perforations is provided in the beverage 422, the purpose of which is explained below.

Operative means in the form of a plunger 432 is provided in the first part 416 and comprises an elongate rod 434 extending between a button 436 to be pressed to operate the operative means 432, and piercing means 438 at the opposite end region of the rod 434 to pierce a membrane 440 separating and isolating the first and second parts from each other. The operative means extends through an elongate hole 435 through the cylindrical chamber 417.

The piercing means 438 is in the form of a substantially cylindrical member, the lower end 439 being open. The edge of the cylinder surrounding the open end is sharp and can readily pierce the membrane 440 which is in the form of a suitable plastics or metal foil, for example aluminium foil.

In operation, the button 436 is depressed which causes the piercing means 438 to pierce the membrane 440. Upon piercing of the membrane, the water in the space between the outer and inner walls 424, 426 is adsorbed by the adsorbent 418, and evaporates from the wicking means 428 thereby extracting heat from the beverage 422. In order to ensure that heat is extracted from all parts of the beverage 422, the device 410 is inverted to enable the mixing disc 430 to descend under gravity thereby creating eddy currents in the beverage 422 and stirring the beverage.

As the water evaporates from the wicking means, it is absorbed by the adsorbent 418 until all the water has been so adsorbed or until the adsorbent is substantially exhausted and there is no further significant driver to the evaporative process.

A ring pull 442 is provided to open an aperture in the can and allow the beverage to be consumed.

Figure 2:
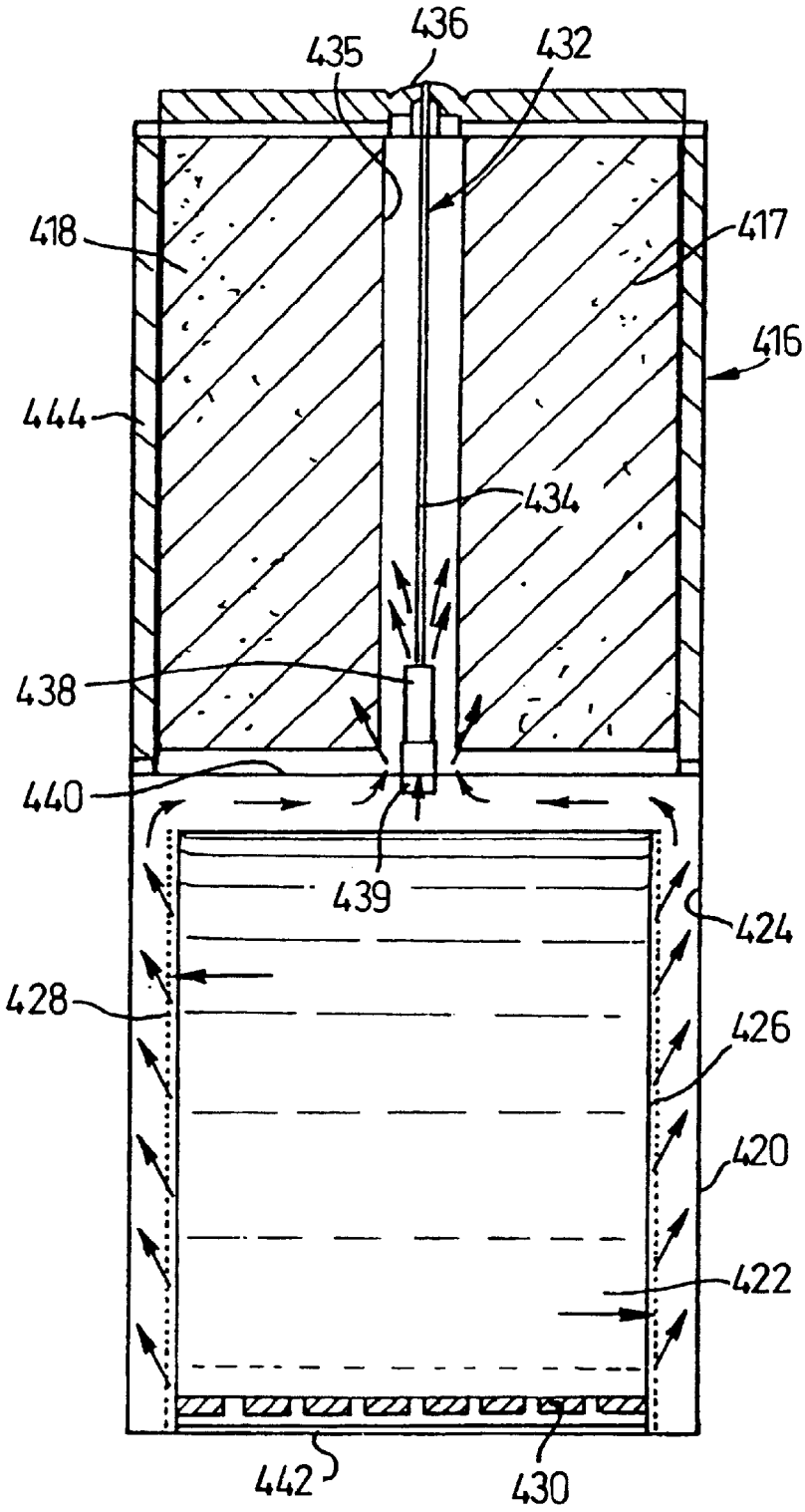
FIG. 2 shows a modification of the device shown in FIG. 1.

Referring to FIG. 2, there is shown a modification of the device shown in FIG. 36 in which the first part 416 is surrounded by heat absorption means, or a heat sink 444. The heat sink 444 absorbs heat from the adsorbent 418.

The heat sink 444 could, for example, be further wicking means, soaked in a suitable refrigerant e.g. water, whereby as the adsorbent releases heat of adsorption, the refrigerant evaporates thereby removing the heat of adsorption from the device. Again, the further wicking means could be a porous cloth, for example a cloth sold under the Trade mark J-Cloth.

Alternatively, in an embodiment not shown, the further wicking means could be provided around the inside walls of the elongate hole 435.

Micro capsules containing water may be provided in the further wicking means to enhance the removal of heat of adsorption. The micro capsules may contain water (or other high heat capacity material) or they may contain phase change material. It is envisaged that of the order of tens, several tens, hundreds, several hundred, or even thousands of microcapsules would be used. The microcapsules may not have an outer skin and a core of different material; they could be of a single material (e.g. wax pellets) or metal powder or granules.

Both the first part and the second part of both embodiments, shown in FIGS. 1 and 2 are placed under vacuum.

The adsorbent is placed in a cylinder made from stainless steel or copper mesh. The operative means extends through the hole 435 through the centre of the cylinder.

Referring to FIGS. 3 to 5, there is shown a heat transfer device 510 which comprises a first part 512 which holds an adsorbent 514 (e.g. activated carbon) arranged in a cylinder of stainless steels or copper mesh 516. A second part 518 is provided on the first part 512 and extends into a beverage to be cooled 520. The second part 518 consists of a cylindrical tube 522 having provided on the inner surface thereof wicking means 524 which is saturated with a suitable refrigerant, for example, water. Heat exchange means in the form of wire filaments, loops, protrusions, or fins 526 extend outwardly from the tube 522. Both the first and second parts 512, 518 are under vacuum/low pressure.

Operative means 528 is provided in the first part 512 and extends through a bore in the cylinder holding the adsorbent 514. The operative means 528 comprises a button 530 and piercer 532 adapted to pierce a membrane 534 separating and isolating the first and second parts from each other. A rigid rod 536 extends between the button 530 and the piercing means 532 such that depression of the button 530 causes the piercing means 532 to pierce the membrane 534.

Referring to FIGS. 4A to 4C, there is shown the sequence of events for using the device shown in FIG. 3.

FIG. 4A shows the device as it appears in FIG. 3 i.e. before operation. Referring to 4B, when it is desired to consume the beverage 520, the button 530 is pushed down. This causes the piercing means 532 to be pushed through the membrane 534 by the rod 536 and ruptures the membrane 534.

Immediately this is done, the water on the, pre-wet, wicking means 524 evaporates and is adsorbed by the absorbent 516. This extracts heat from the beverage 520 and this heat extraction is enhanced by the fins 526. The fins 526 could be bushes of wire strands, for example like wire wool. This would have a large surface area and good thermal conductivity, and would allow the beverage 520 to flow through the bushes.

When the heat transfer has been completed, and the beverage 520 is cooled, a ring pull 538 can be pulled to allow the beverage 520 to be poured into a glass 540 for consumption.

Referring to FIG. 39, there is shown a modification to the device shown in FIG. 37 in which the inside of the tube 522 forming the second part 518 is provided with an internal arrangement 542 of looped wire, similar to that provided outside.

A filter may be provided to prevent any parts of the heat exchange mechanism that have broken off in transport, storage, or use, of the container from being dispensed from the can via the aperture by the ring pull. The heat exchanger or cooling unit may be provided in a porous/permeable bag/shroud.

Referring to FIG. 6, there is shown a further embodiment 610 in which a first part 612 comprises a vessel having a double skin inner and outer wall 616, 618, the adsorbent 614 being arranged circumferentially around the outer wall 618. An inner tube 620 extends into the beverage 622 and comprises wicking means 624 arranged internally of the tube 620, and fins 626 extending outwardly from the tubes 620 into the beverage 622. The second part 628 is provided separate from the vessel, and comprises a copper container 630 holding a refrigerant 632, for example water. A conduit 636 extends from the container 628 to a region adjacent the bottom of the tube 620. A valve 638 is provided in the pipe 636 which is initially set to its closed position and, upon opening, allows water in the container 630 to flow into the tube 620. An arrangement of conduits 640 extends from the tube 620 into the first part 612 for the purpose of delivering evaporated refrigerant to the first part 612. A water trap 642 is provided at the top of the tube 620 to connect the tube 620 to the conduit arrangement 640, whereby any water condensing prior to entering the conduit arrangement 640 is returned back to the tube 620 to undergo evaporation again.

In operation, the valve 638 is opened and water from the container 630 is emptied into the tube 620. The water is then dispersed by the wicking means around the inside of the tube 620 and is evaporated by the transfer of heat from the beverage via the fins 626. The evaporated water thereby extracts heat from the beverage to cool it down. Water vapour passes through the tube via the conduit arrangement 640 into the first part 612 to be adsorbed by the adsorbent 614 arranged on the outer wall 618. A covering of insulating material 644 is provided around the inner wall 616 to ensure that once cooled, the beverage 622 is kept cool. When the cooling process is completed, the ring pull 646 can be pulled to allow the beverage to be consumed. The ring pull 646 could be a closable closure, to enable the beverage chamber to be sealed closed after opening, and possibly re-filled with beverage.

A lid 648 is provided which can be removed to allow the water in the adsorbent 614 to be discharged thereby allowing the device to be used again.

Referring to FIG. 7, there is shown a modified device 710 which comprises an inner cylinder 712 holding a beverage 714. Wicking means 716 is provided on the wall of the cylinder 712. An outer wall 718 is provided on the inside thereof with an adsorbent 720 which extends substantially wholly around the inside of the wall 718.

A container 722 is provided separate from the vessel and contains a suitable refrigerant, for example water. The container 722 is connected to the wicking means 716 via a conduit 724 and a valve 726. The space between the inner and outer walls 712, 718 is under vacuum.

On operation, the valve 726 is opened to allow the water in the container 722 to empty into the space between the two walls 718, 712 whereupon the water is dispersed around the outside of the cylinder holding the beverage 714. In evaporation the water therefrom extracts heat from the beverage 714. The evaporated refrigerant is then adsorbed by the adsorbent 720 surrounding the inside of the outer wall 718. In this way, the beverage 714 is cooled.

A lid 728 (e.g. plastic) is provided to cover the space between the inner and outer wall 718, 712 and the conduits 724 is formed in the lid 728. An evacuation point 730 is provided on the lid, to allow the water adsorbed onto the adsorbent 720 to be discharged therefrom to allow the device to be used again. The container 722 can be refilled with water through a suitable fill point 732. The container 722 is suitably formed from copper.

Referring to FIG. 8, there is shown a further embodiment 710 and is formed in two separate but connected elements 712. The first element 712 comprises a large cylinder the adsorbent 718 extends substantially wholly around the inside of the wall of the cylinder 716. A lid 720 is provided on the cylinder to allow water adsorbed onto the adsorbent 718 to be reused.

The second element 714 comprises a tubular member 722 having provided on the outside thereof a plurality of fins 724. Wicking means 726 extends around the inside of the wall of the tube 722. A container 728, initially charged with a refrigerant, for example water is provided separately from the tube 722 and is connected thereto by pipes 730 and a valve 732. A flange 734 is provided to connect the two elements 712, 714 together.

On operation, the first element 712 is connected to the second element 714 by the flange 734. The tube 722 is then inserted in a material to be cooled, and a valve 732 is opened to allow the water to enter the tube 722 to be dispersed around the inside wall of the tube. Heat is transferred to the inside of the tube via the fins 724 to evaporate the water thereby cooling the material. The evaporated water is then passed into the first element 712 to be adsorbed by the adsorbent 718. When the process is completed, the cooled material can be consumed, and the first clement can be used again by removing the water from the adsorbent 718 by, for example, heating.

FIG. 9 is based upon FIG. 3 but shows enhancements which may be provided. The skilled person will appreciate that the enhancements shown in relation to FIG. 9 could equally well be applied to any other of the embodiments shown in the various Figures of this description.

Figures 9A, 9B, 9C, 9D, 9E:
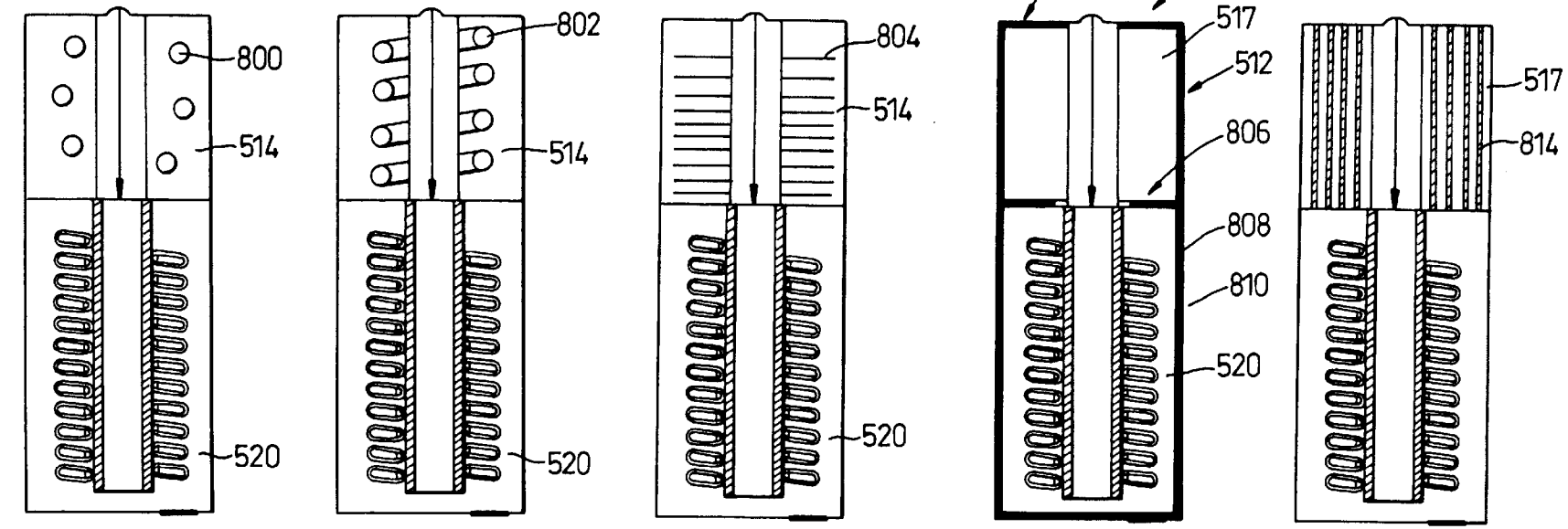

FIG. 9*a* shows pockets 800 of a phase change material provided within the within the take up agent (e.g. adsorbent) 514. As the device is used the temperature of the take up agent 514 rises and eventually the material provided within the pockets either melts, vaporises, or sublimates. This change of phase of the material within the pocket 800 requires a heat input which is absorbed from the take up agent 514. This absorption of heat reduces the temperature of the take up agent thus improving the rate of cooling of the beverage 520. The absorbing/take up reaction of the take up agent/evaporant is an equilibrium reaction and operates faster the further away from equilibrium—it is therefore helpful to cool the take up agent to maintain the speed of reaction and hence speed of cooling of the beverage.

FIG. 9*b* shows a tube 802, provided as a spiral within the take up agent 514. The tube is fabricated from a metal, in this case aluminium, so that it conducts heat rapidly. The tube is filled with water which absorbs heat from the take up agent 514 again increasing the rate of cooling of the beverage 520. The tube and its water is a heat sink.

FIG. 9*c* shows cooling fins 804 extending into the take up agent 514. As with the embodiments shown in FIGS. 9*a* and 9*b* the fins are adapted to remove heat from the take up agent 514 so that its rate of change of temperature is reduced which promotes cooling of the beverage 520.

FIG. 9*d* shows the provision of insulation around the heat transfer device 510. A portion of insulation 806 is provided between the first part 512 (containing the take up agent) and the beverage container 808 which is adapted to prevent heat from the take up agent 517 from reaching the beverage 520. It will be appreciated that in this embodiment the heat transfer device is adapted to cool the beverage 520 and that therefore it is not desirable for heat to reach the beverage 520.

A portion of insulation 810 is provided around the beverage container 808 and is adapted to prevent heat reaching the beverage 520 from the atmosphere.

A further portion of insulation 812 is provided around the first part 512 and is adapted to prevent the outside of the heat transfer device 510 from becoming too hot. It will be appreciated that the take up agent is absorbing heat and will therefore experience a temperature rise. This may become dangerous or uncomfortable for a user. Indeed, this may cause a psychological effect wherein the user knows that the heat transfer device 510 is adapted to cool the beverage 520 but is somewhat surprised by the device 510 becoming hot and may not perceive the cooled beverage as really being as cold as it is.

FIG. 9*e* shows channels 814 provided within the take up agent 517. These channels are adapted to maximise the surface area of the take up agent and improve efficiency of the cooling process of the beverage 520. They take the water vapour (evaporant) to different regions of the take up agent, preventing localised saturation of the take up agent (and localised heating) which would serve to stop/retard the equilibrium drive of the process: ensuring that substantially the whole body of the take up agent is exposed to water vapour makes for a further cooling process for the beverage.

The skilled person will appreciate that the features shown in FIG. 9 are applicable to any of the embodiments shown herein, including those adapted to heat a beverage or food stuff. Indeed, some embodiments may have a combination of the features shown in FIG. 9. With respect to FIG. 9*d* only some of the portions of insulation may be provided, and the purpose of the insulation may be different (although readily apparent) if it is provided on devices adapted to heat a beverage or foodstuff.

Where "heat-pipe" is referred to in the foregoing description, it is to be understood as including any one or more of needle heat-pipes, loop heat-pipes or micro heat-pipes.

Various modifications can be made without departing from the scope of the invention. For example, each of the embodiments shown above comprises one adsorber or absorber unit. The devices may comprise two or more absorber or adsorber units to enhance the cooling/heating programme. Also, a device may comprise a combination of solid/gas adsorption and liquid/gas absorption. In the pocket/portable coolers/heaters (or, indeed any of the embodiments shown in the drawings) the refrigerant may be desorbed from the adsorbent to allow the adsorbent to be re-used.

FIGS. 10*a* to 10*d* show heat sink devices which in some embodiments may be provided distributed in the evaporant take up agent/adsorbent. A spiral shape, such as that of FIG. 10*a*, or a convoluted shape, as in FIG. 10*d* (which need not be planar) are space-efficient. Smaller, simpler shapes such as shown in FIGS. 10*b* and 10*c* may be used. The heat sink devices may simply be of a material with high heat capacity (e.g. metal), or they may be of a phase change material, e.g. wax. They may have an outer skin or sheath of one material and a core of another (e.g. metal, or cloth, or plastics skin with a phase change core). They may be distributed through the body if adsorbent.

FIG. 11*a* shows a cake of adsorbent (e.g. carbon) 900 having heat sink, particles 902 randomly distributed in it. The heat sink particles 902 are made of metal in this example. FIG. 11*b* shows a cake of adsorbent (e.g. carbon or zeolite) with both metal particles 902, and phase-change heat sink particles 904 distributed within it. The phase change particles are preferably non-toxic to humans, as are preferably all materials in the container/can. That is why carbon/water is preferred as the adsorbent/evaporant, and why wax is preferred as heat sink/phase change material.

FIG. 12*a* shows a heat sink/sphere 910 having a stem 912 containing a core 914. The core 914 is of high heat capacity material, e.g. water. The stem 912 is a good thermal conductor, e.g. a metal foil/metalised membrane. FIG. 12*b* shows a capsule 916 having an outer wall 918 of retaining material, e.g. wax, cloth, metal or plastic, and a core 920 of phase change material.

FIG. 12*c* shows a capsule 920 having an outer skin 922, an inner core 924, and an intermediate layer 926. The intermediate layer 926 could be of a phase change material or high heat capacity material and could be solid or liquid. The core could be of phase change material or high heat capacity material and would be solid or liquid. In one version the core is water and the intermediate layer is a phase change material, such as wax. The outer stem may itself be of wax and may or may not melt in use (e.g. the wax of the skin could have a higher melting point that that of the intermediate layer or core).

Figure 13A:
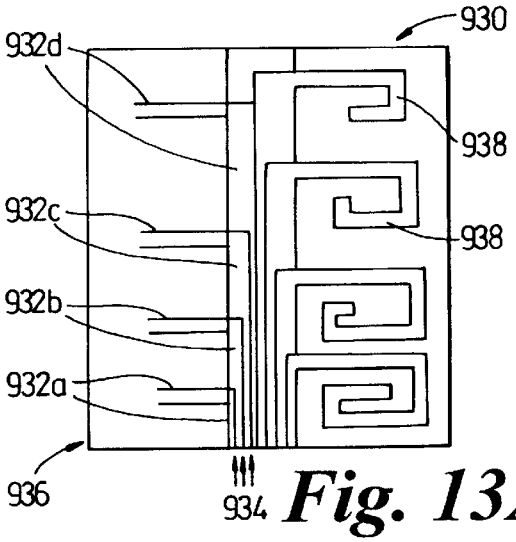

FIG. 13*a* shows a body 930 of adsorbent (or other evaporant take up agent) having a number of channels 932*a*, 932*b*, 932*c*, 932*d*, provided in it. Each channel 932 has its own entrance 934 and water vapour (or other evaporant vapour) enters via the entrances 934. This ensures (and the aim of the improvement is to ensure) that not all of the water vapour is adsorbed at the end, referral 936, of the body of adsorbent near the vapour entrance to the body. If no channels/guide/splitter for the vapour was not provided the vapour may tend to condense on the lower parts of the body first, and the adsorption reaction would be greatly unequal over the height of the body 930. The separate channels 932*a* to 932*d* ensure that "fresh" vapour reaches the further/remote parts of the adsorbent.

The right hand half of FIG. 13*a* shows another modification in which the passages/channels 932 are not simply straight, but are convoluted (938) in order to have a larger surface area/have less of the body of adsorbent so far away from the nearest channel portion/place where water can be adsorbed. Of course, the channels can have an arcuate extent around the can/container, and may have both a circumferential extent and an axial extent. The body 930 may be made of sections which define the channels between them, as shown in FIG. 13*d*. The sections may be circular and may stack one above the other, possibly with protrusions to hold them apart so as to define the channels.

Figure 13B:
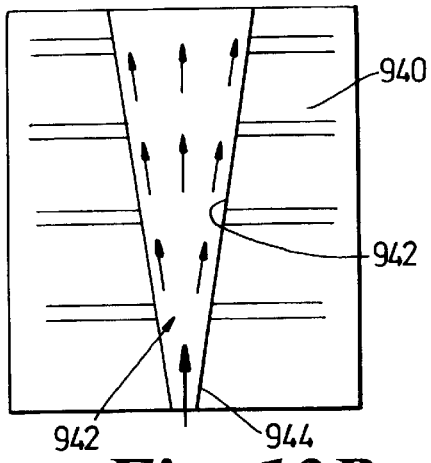

FIG. 13*b* shows another body of adsorbent/take up material 940 which has a channel 942 into which vapour enters at entry 944. The channel 942 is shaped so that at its entry the vapour is flowing relatively quickly, and such that further downstream in the channel, for example at point 946, the flow is slower. This means that vapour reaches the downstream regions of the channel since at least some of it rushes past the upstream surfaces of adsorbent before it can be adsorbed, thereby spreading out the adsorption over a larger volume of the body, or makes the adsorption more even over the volume of the body. This may be achieved in part by having the channel 942 have an increased cross-sectional area at a region downstream of the entry 944, and it may have a progressively, or stepped, widening of cross-section.

Figure 13C:
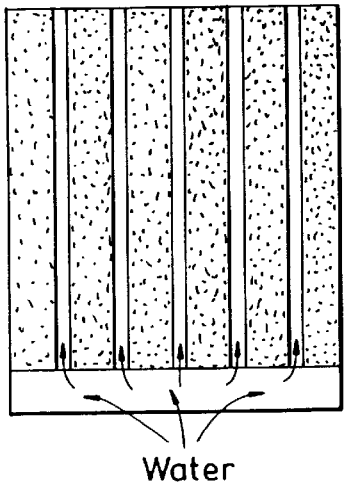
Figure 13D:
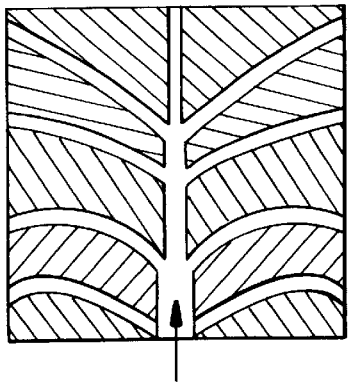

FIG. 13*c* shows another way of spreading out the adsorption of reaction over a larger volume of body of adsorbent.

FIG. 14 shows a body 950 of adsorbent (or other take up material) 951 with a liquid cooling system. Water cooling channels 952 are provided and movable circulation drivers 954 are provided in the channels 952, as is water 955. Access to the adsorbent 951 for the evaporated water vapour (or other vapour) is not shown, but does exist. In this example the circulation drivers 954 are bodies with a through bores 956. When the body 950 is inverted the drivers 954 slide down the channels 952, with the water 955 flowing through the bores 956 as they move under gravity. This causes turbulent mixing of the water 955, which aids heat transfer from the body 950 to the water 955. The drivers 954 may be parts of a common member, e.g. a plate. They may not be of the same cross-section as the channels, allowing water to slide past them. They may not then need bores 956.

The coolant liquid circulation achieved by drivers 954 is, of course, similar to that achieved by plate 430 for the beverage itself. The plate 430 and driver 954 may be different components, or they may be provided by a common gravity driven component. In a modification instead of being gravity driven the beverage mixer and/or coolant fluid mixer may be manually driven. They may be gravity driven as they fall, and manually returnable to an elevated position. Alternatively the user may be directed to turn the container upside down periodically whilst it cools, so as to enable the plate 430 and/or drivers 954 to operate repeatedly.

FIG. 15 shows a temperature gradient over a block of adsorbent. This may encourage the reaction to use the cooler parts of the block. The usage of the block may therefore be in part self-regulating. However, for maximum speed of cooling of the beverage large temperature gradients over the adsorbent are to be avoided since they demonstrate that some parts of the adsorbent are not taking up as much vapour as they could be (and indeed as other parts of the adsorbent are taking up).

The performance of the self-cooling can/container is intended to cool a can at an initial temperature of 20–25° C. to a final temperature of around 8° C.±a few ° C. in a time of 2 minutes or less.

It will be appreciated that the self-cooling container of main interest is likely to be a can, or other container having about 300–500 ml or so of beverage. Typical cans and bottles have 275 ml, 330 ml, 440 ml, 500 ml of beverage, and the temperature reduction performance envisaged is for such containers.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A self-cooling beverage container having a beverage chamber adapted to hold a beverage, an adsorbent, an evaporative refrigerant, an isolator isolating the refrigerant from the adsorbent, and an actuator adapted in use to communicate the adsorbent with the refrigerant so that, in use, the evaporative refrigerant evaporates and is adsorbed by the adsorbent, evaporation causing cooling of the beverage in use, wherein there is provided a beverage mixing means adapted to ensure that the beverage to be cooled is mixed or made turbulent during cooling of the beverage.

2. A self-cooling beverage container having a beverage chamber adapted to hold a beverage, an adsorbent, an evaporative refrigerant, an isolator isolating the refrigerant from the adsorbent, and an actuator adapted in use to communicate the adsorbent with the refrigerant so that, in use, the evaporative refrigerant evaporates and is adsorbed by the adsorbent, evaporation causing cooling of the beverage in use, wherein there is provided a beverage mixing means adapted to ensure that the beverage to be cooled is mixed or made turbulent during cooling of the beverage, and wherein said beverage mixing means comprises a gravity moved member adapted to move through the beverage under the influence of gravity.

3. A self-cooling beverage container having a beverage chamber adapted to hold a beverage, an adsorbent, an evaporative refrigerant, an isolator isolating the refrigerant from the adsorbent, and an actuator adapted in use to communicate the adsorbent with the refrigerant so that, in use, the evaporative refrigerant evaporates and is adsorbed by the adsorbent, evaporation causing cooling of the beverage in use, wherein there is provided a beverage mixing means adapted to ensure that the beverage to be cooled is mixed or made turbulent during cooling of the beverage, and wherein the member comprises a sliding body provided with through-holes.

4. A self cooling beverage container having a beverage chamber, a beverage in the beverage chamber, a body of adsorbent material, an evaporative refrigerant held on a wick, an isolator isolating the wick from the adsorbent body, and an actuator operable in use to communicate the adsorbent with the wick so that said evaporative refrigerant evaporates and is adsorbed by the adsorbent, with the evaporation cooling the beverage, and wherein the adsorbent is activated carbon, the evaporative refrigerant is water, and the evaporative process occurs at sub atmospheric pressure; and wherein a mixer is provider in said beverage chamber, said mixer being gravity operated by inversion of the container to cause said mixer to move and thereby mix the beverage to assist cooling of the beverage; and wherein said adsorbent body has heat take up means provided in it, said heat take up means comprising at least one of: i) microcapsules or regions of phase change material or heat capacity material distributed in said body; ii) liquid cooled surfaces provided on said adsorbent body; and wherein said wick is thermally coupled with at least one of: i) heat exchange fins extending into said beverage; ii) extensions or loops of wire in thermal contact with said beverage.

5. A method of cooling a beverage comprising taking a self-cooling beverage container having a beverage chamber adapted to hold a beverage, an adsorbent, an evaporative refrigerant, an isolator isolating the refrigerant from the adsorbent, and an actuator adapted in use to communicate the adsorbent with the refrigerant so that, in use, the evaporative refrigerant evaporates and is adsorbed by the adsorbent, evaporation causing cooling of the beverage in use, wherein there is provided a beverage mixing means adapted to ensure that the beverage to be cooled is mixed or made turbulent during cooling of the beverage, and wherein said beverage mixing means comprises a gravity moved member adapted to move through the beverage under the influence of gravity and actuating said actuator, and then periodically inverting said container to cause said gravity moved member to move repeatedly through said beverage, in opposite directions relative to said container, repeatedly mixing said beverage prior to opening said beverage container.

* * * * *